United States Patent [19]

Gourdeau et al.

[11] 3,936,107

[45] Feb. 3, 1976

[54] DOOR CONSTRUCTION

[75] Inventors: William F. Gourdeau; Ronald E. Hahn, both of St. Joseph, Mich.

[73] Assignee: Whirlpool Corporation, Benton Harbor, Mich.

[22] Filed: Sept. 16, 1974

[21] Appl. No.: 506,183

[52] U.S. Cl. ..... 312/138 R; 52/627; 126/200; 312/204; 312/257 A

[51] Int. Cl.[2] ..... A47B 47/00

[58] Field of Search..... 312/195, 138 R, 204, 214, 312/257 A; 52/311, 476, 511, 512, 618, 624, 627, 625, 718; 40/63 R; 161/18, 43; 126/200; 134/57 D, 58 D, 200

[56] References Cited

UNITED STATES PATENTS

| | | | |
|---|---|---|---|
| 2,572,164 | 10/1951 | Rogers et al. | 52/476 X |
| 2,580,957 | 1/1952 | Reeves | 126/200 |
| 2,623,249 | 12/1952 | Miller | 52/476 |
| 2,859,843 | 11/1958 | Allen | 52/512 |
| 3,024,074 | 3/1962 | Jacobs et al. | 134/200 X |
| 3,149,624 | 9/1964 | Reeves | 126/190 X |
| 3,294,461 | 12/1966 | Barnard et al. | 312/204 X |
| 3,328,927 | 7/1967 | Kades | 52/311 X |
| 3,525,190 | 8/1970 | Saunders et al. | 52/624 |
| 3,773,399 | 11/1973 | Sulcek | 312/204 |

FOREIGN PATENTS OR APPLICATIONS

| | | | |
|---|---|---|---|
| 451,051 | 9/1948 | Canada | 312/214 |
| 541,733 | 12/1941 | United Kingdom | 52/627 |

*Primary Examiner*—William H. Schultz
*Assistant Examiner*—Thomas J. Holko
*Attorney, Agent, or Firm*—Wegner, Stellman, McCord, Wiles & Wood

[57] ABSTRACT

A door construction arranged to permit interchangeable disposition of a selected panel face of any one of a plurality of different panels having different appearances. The door construction may include a fire wall panel forwardly of electrical control wiring therein and an interchangeable decorative panel assembly may be removably installed forwardly of the fire wall panel. The decorative panel assembly has a thickness similar to that of conventional wood paneling, thus permitting substitution of wood paneling in the door construction as desired. The door construction is arranged to permit facilitated changing of the exposed panel face at any time. The fire wall panel is electrically conductive and grounded and the decorative panel assembly is spaced forwardly of the fire wall panel. A control console at the top of the door construction is recessed to receive an upper edge portion of the decorative panel assembly for facilitated installation and removal.

18 Claims, 7 Drawing Figures

DOOR CONSTRUCTION

BACKGROUND OF THE INVENTION

1. Field of the Invention

This invention relates to door constructions and in particular to door constructions for use in electrical appliances such as dishwashers and the like.

2. Description of the Prior Art

A number of different door constructions have been provided for use in closing the front of an open cabinet. Illustratively, in Melvin A. Jung U.S. Pat. No. 3,105,726, a desk is provided with interchangeable panels which are effectively hung by means of upper brackets from an upper hanger and securing screws extending through a lower support of the desk into a lower flange of the panels.

In U.S. Pat. No. 3,294,461 of Walter C. Barnard et al, owned by the assignee hereof, a dishwasher door construction is shown having a panel arrangement permitting the selective disposition of different decorative panels.

In Raymond C. Sandin U.S. Pat. No. 3,313,065, a cabinet door is disclosed utilizing trim strips to frame and retain a rectangular panel against an outer wall of the door. The trim strips are removably secured to the door so as to permit substitution of different panels.

In Jay F. Kates U.S. Pat. No. 3,328,927, a panel for use in elevator cabs is disclosed permitting substitution of different decorative panels by a pivoting of a mounting board.

In Charles A. Wilcox et al. U.S. Pat. No. 3,501,186, a trim mounting strip is provided wherein a replaceable front panel is retained.

In Orson V. Saunders et al. U.S. Pat. No. 3,525,190, a door construction is disclosed wherein replacement of the front panel may be effected by removal of a top horizontal trim member.

In Charles E. Sulcek U.S. Pat. No. 3,773,399, owned by the assignee hereof, an interchangeable front panel means for a refuse compactor drawer is disclosed.

Thus, the prior art shows a number of different structural arrangements for use in providing interchangeability of door panels in door constructions for use in appliances and the like.

SUMMARY OF THE INVENTION

The present invention comprehends an improved door construction providing further facilitated interchangeability of a plurality of decorative panels. A plurality of decorative panels are facially juxtaposed and installed as an assembly in the door construction with a selected face of a selected panel thereof forwardmost to provide a desired aesthetic effect. The door construction is arranged to permit facilitated interchangeability of the panel faces by means of a facilitated removal, rearrangement and reinstallation of the rearranged panel assembly.

More specifically, the door construction includes a fire wall panel extending substantially across the space defined by the door frame with the electrical control and wiring carried by the door rearwardly of the fire wall panel. The fire wall panel may be formed of an electrically conductive material, such as metal, and is preferably grounded.

The decorative panels may comprise metal-faced sheets suitably painted in different colors and the assembly may include a rear, waxed corrugated sheet confronting the fire wall panel.

The assembly may be biased forwardly away from the fire wall panel by resilient biasing means which, in the illustrated embodiment, comprise spring clips engaging the opposite side portions of the panel assembly. The spring clips may further define the means for securing the fire wall panel to the frame.

The door construction may include a console enclosure housing the electrical control at the top of the door construction. The enclosure may define a downwardly opening recess receiving the top edge portion of the panel assembly. The lower edge portion of the panel assembly may be provided with a U-shaped channel. The channel embraces the lower edge of the panel assembly and the panel and lower portion of the frame may be provided with cooperating releasable securing means for holding the lower edge portion of the panel assembly against movement forwardly from the door construction. In the illustrated embodiment, the holding means comprises cooperating male and female elements permitting the panel assembly to be moved upwardly into the console recess sufficiently to effect disengagement of the holding means and permit the panel assembly to be moved downwardly and forwardly from the recess and from the door construction. The panel assembly with the selected decorative panel face outermost, may be reinstalled by a simple reverse procedure.

The edge portions of the panel assembly may be retained against forward movement by removable trim strips along the side edges of the frame.

Thus, the door construction of the present invention is extremely simple and economical of construction while yet providing facilitated interchangeability of the decorative panel surfaces.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
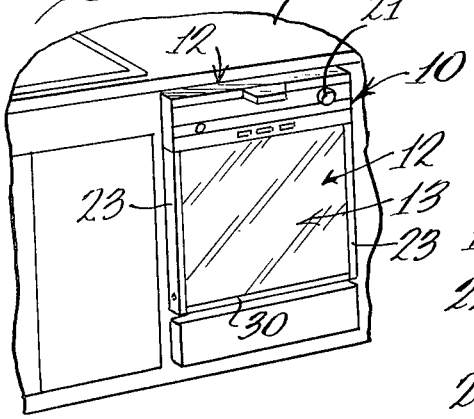
FIG. 1 is a perspective view of a counter having a dishwasher provided with a door construction embodying the invention.

In the exemplary embodiment of the invention as disclosed in the drawing, a dishwasher generally designated 10, illustratively adapted to be mounted in a conventional kitchen counter 11 is provided with an improved door construction generally designated 12 embodying the invention.

Door construction 12 is provided with an improved decorative panel means 13 permitting interchangeability of a plurality of decorative services with the interchanging thereof effected in a novel and simple manner.

Figure 2:
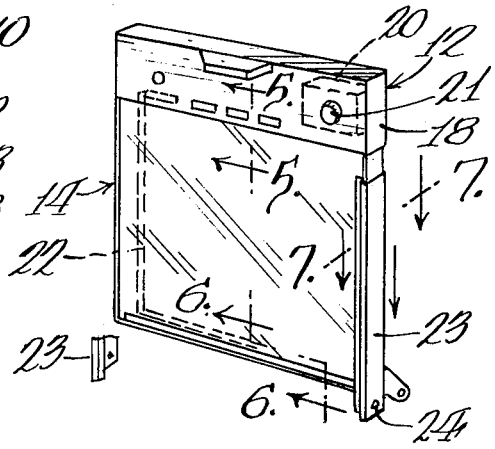
FIG. 2 is a perspective view of the door construction illustrating the removal of the trim strips therefrom in a first step in the removal of the decorative panel assembly from the door construction.

More specifically, as shown in FIG. 2, the door construction includes a frame 14 and having side portions 15 and 16, a bottom portion 17, and a top console enclosure 18 defining a space 19 across which the panel means 13 extends in the assembled arrangement of the door. Console 18 carries suitable control elements 20 for use with a manual control knob 21 in effecting operation of the dishwasher. Wiring 22 to the control 20 extends downwardly through the rear of space 19 for suitable interconnection with other electrical components of the dishwasher (not shown).

As illustrated in FIG. 2, the door includes channel-shaped trim strips 23 embracing the side portions 15 and 16 of the frame and removable therefrom upon release of suitable detent means 24 as by insertion of a knife blade between the lower end of the trim strip and the door frame. The released trim strip is moved downwardly to permit the rear portion thereof to clear a plurality of projecting portions 25 on the rear of the frame portions 15 and 16 and permit the trim to be turned free of the frame portions 15 and 16.

Figure 3:
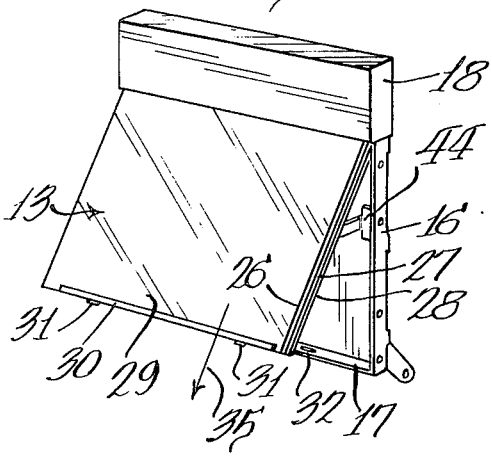
FIG. 3 is a perspective view showing a further step in the removal of the panel assembly.
Figure 4:
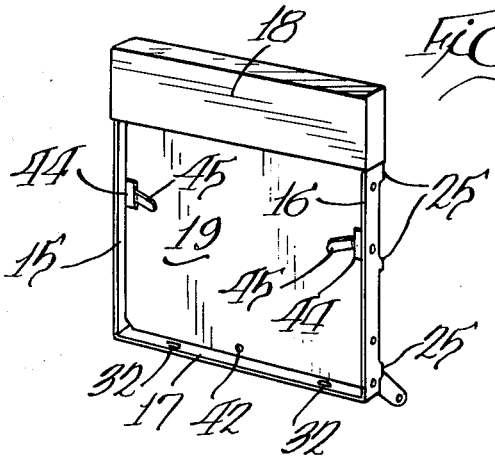
FIG. 4 is a perspective view showing the door construction with the panel assembly removed.
Figure 5:
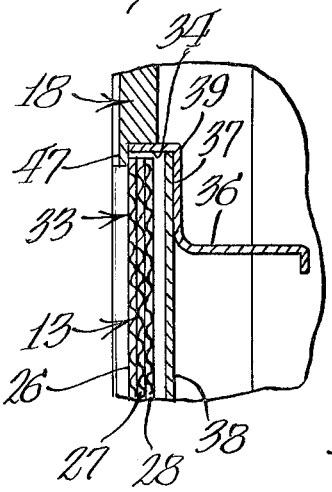
FIG. 5 is a fragmentary enlarged vertical section taken substantially along the line 5—5 of FIG. 2.

Panel assembly 13 is defined by a plurality of decorative panels 26 and 27 and a corrugated protective panel 28. The assembly is maintained as a panel pack at the lower edge portion 29 thereof by a U-shaped channel 30. As shown in FIG. 3, the channel embraces the lower edge portion 29 and is provided with a plurality of downwardly projecting tabs 31 adapted to be received in complementary slots 32 in the bottom frame element 17. As shown in FIG. 5, the upper edge portion 33 of decorative panel pack 13 is received in a recess 34 defined by console enclosure 18. Sufficient clearance is provided above the panel pack 13 to permit the pack to be upwardly moved slightly to disengage tabs 31 from slots 32 when it is desired to move the pack from the door construction. With the side trim strips 23 removed, the pack may be swung outwardly to permit the entire pack to be removed from the door construction by a forward and downward movement in the direction of the arrow 35, as shown in FIG. 3.

Recess 34 may be defined in part by a frame element 36, as shown in FIG. 5, having a downturned mid-portion 37.

A metal fire wall panel, or barrier panel, 38 extends across the rear of space 19. The upper edge portion 39 of the barrier panel is facially juxtaposed to the frame portion 37, as shown in FIG. 5, and the lower edge portion 40 is positively secured to a downturned flange 41 of the door frame by suitable electrically conducting fastening means, such as metal screw 42, which serves to electrically ground the panel 38 to the door frame 14 which is of metal, and which is electrically grounded on installation of the dishwasher to eliminate electrical shock hazard.

Figure 6:
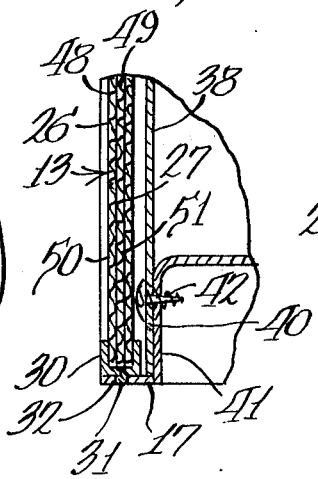
FIG. 6 is a fragmentary enlarged vertical section taken substantially along line 6—6 of FIG. 2.
Figure 7:
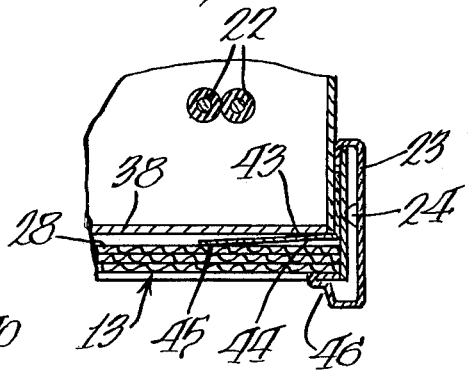
FIG. 7 is a fragmentary horizontal section taken substantially along the line 7—7 of FIG. 2.

The side portions 43 of the barrier panel are retained to the door frame by a pair of spring clips 44 at the opposite sides of space 19. Each spring clip includes a tongue portion 45 extending resiliently forwardly into space 19 to engage the protective panel 28 at the rear of the decorative panel pack and urge the pack forwardly against an inturned flange 46 of the trim strips 23 and a depending flange 47 defining the forward end of recess 34. As shown in FIGS. 5–7, the spring clips resultingly dispose the decorative panel pack in forwardly spaced relationship to the barrier wall. The biasing of the clips maintains the several elements of the decorative panel pack against movement and eliminates undesirable noise and rattling in the dishwasher during operation.

As indicated above, panel pack 13 may include at least two decorative panels and a protective panel. Each decorative panel may have its opposite faces differently decorated and, thus, four different decorative surfaces may be utilized as the front surface of the door construction by simple interchanging of the panels. More specifically, panel 26 may define a first face 48 and a second face 49. Second decorative panel 27 may define a first face 50 and a second face 51. In one commercial version of the door construction, the panels 26 and 27 comprise painted steel panels with surface 48 painted harvest gold, surface 49 painted avocado, surface 50 painted coppertone, and surface 51 painted white. Any of the surfaces may be selected as the decorative face of the door construction by simply disposing the panel with the selected face forwardmost in the pack assembly and reinstallation of the channel 30 in embracing relationship to the bottom edge thereof. The thusly selectively re-arranged pack is then reinstalled in the door construction by reversely installing the upper edge portion in the recess 34 and swinging the lower edge portion into the lower portion of the space 19, thereby permitting the tabs 31 to seat in the slots 32 with the upper portion of the pack being biased forwardly against flange 47 of the console by the spring clips 44. The side trim strips 23 are reinstalled and locked into place to complete the installation with the flange portions 46 thereof further serving to retain the decorative panel pack against movement forwardly from the space 19, as shown in FIG. 7.

Barrier panel 38 is preferably formed of metal and defines a flame-proof shield between the electrical wiring 22 and control 20 and any flammable material on the front of the door. In the illustrated embodiment, the protective panel 28 comprises a waxed corrugated board panel which is thusly protected by the barrier panel 38.

The thickness of the decorative panel assembly is preferably approximately ¼ inch so as to be generally similar to the thickness of conventional wood paneling permitting the installation of a ¼ inch thick wood panel such as one matching the cabinetry wood of the cabinets in the kitchen in which the dishwasher 10 may be installed as an alternative decorative panel in the door construction. The wood panel is retained in the door construction in the same manner as the decorative panel assembly with the channel 30 being disposed in embracing relationship to the lower end of the wood panel in the same manner.

As no screws are utilized in securing the interchangeable decorative panel assembly in the door construction, the selective interchanging of panel surfaces may be effected quickly and simply within a matter of a few minutes. Further, a single door construction may be utilized in combination with any one of four differently colored appliances corresponding to the four different colors of the surfaces of the two decorative panels, thereby facilitating stocking and minimizing inventory costs. While the panels are readily interchangeable, the panel assembly is effectively held against rattling and noise during operation of the dishwasher by the resiliently biasing spring clips.

In the illustrated embodiment, the decorative panels comprise metal panels having a thickness of 0.021 inch and the protective panel 28 comprises a 3/16 inch Kraft paper waxed corrugated board. Where a ¼ inch thick wood panel is utilized, the spring clips function similarly in retaining it against rattling and noise in the operation of the dishwasher.

The metal barrier panel 38 is used with either of the painted metal panel or the decorative wood panel arrangements and since it is positively electrically grounded to the dishwasher 10 via the screw 42 associated with the dishwasher door frame 14 the door elements are positively electrically grounded regardless of the front panel arrangement selected. Additionally, the metal barrier panel 38 provides a flameproof shield between the electrical components and wiring 22 in the door 12 and any flammable elements of the exterior decorative panel structure.

In either the painted metal panel arrangement or the decorative wood panel arrangement, end or tongue portions 45 of the spring steel clips 44 bear against either the back of the protective panel or spacer 28 in the panel pack or the back of the wood panel to resiliently urge the front panel forward against the door frame and the inturned edges of the side trim strips 23.

The foregoing disclosure of specific embodiments is illustrative of the broad inventive concepts comprehended by the invention.

The embodiments of the invention in which an exclusive property or privelege is claimed are defined as follows:

1. In a door construction for an electrically operable appliance, having a peripheral frame defining an opening, and electrical control means carried by said frame including wiring extending at the rear of said opening, the improvement comprising: a console enclosure carried at the top of said frame for enclosing the control means and defining a downwardly opening recess extending substantially fully across said opening; a fire wall panel extending fully across said opening to close said opening forwardly of said control means and wiring; a plurality of decorative panels removably installed as an assembly in said frame across said opening spaced forwardly of said fire wall panel, said decorative panel assembly defining an upper edge portion received in said recess and a lower edge portion; cooperating male and female securing means on said frame and decorative panel assembly for securing said lower edge portion of the decorative panel assembly removably to said frame against movement forwardly from said space in an engaged disposition thereof; and biasing means for yieldably retaining said decorative panels in facial abutment in said assembly while permitting limited movement of said decorative panel assembly vertically from said engaged disposition to permit said lower edge portion to be moved forwardly from said space and thereby permit said upper edge portion to be moved downwardly from said recess to remove said decorative panel assembly from said door construction, and permit installation of said decorative panel assembly by a reverse procedure, said biasing means being spaced substantially from said lower edge to maintain facial abutment while being disposed to urge said decorative panel assembly from said frame upon movement of said lower edge portion from said engaged disposition.

2. The door construction of claim 1 wherein said securing means comprises a U-shaped element embracing said lower edge portion of the decorative panel assembly and said cooperating male and female connector means is provided on said U-shaped element and frame.

3. The door construction of claim 1 wherein said securing means includes means for securing said plurality of panels together at said lower edge portion.

4. The door construction of claim 1 wherein said securing means includes U-shaped channel means for securing said plurality of panels together at said lower edge portion.

5. The door construction of claim 1 wherein said decorative panel assembly defines side edge portions and flange means are removably secured to said frame for forwardly overlying the side edge portion of said decorative panel means.

6. The door construction of claim 1 wherein said fire wall panel and frame are formed of metal.

7. The door construction of claim 1 wherein said fire wall panel is formed of metal and electrically conducting fastening means are provided for securing and grounding the fire wall panel to the frame of the appliance.

8. In a door construction for an electrically operable appliance, having a peripheral frame defining an opening, and electrical control means carried by said frame including wiring extending at the rear of said opening, the improvement comprising: a console enclosure carried at the top of said frame for enclosing the control means and defining a downwardly opening recess extending substantially fully across said opening; a fire wall panel extending fully across said opening to close said opening forwardly of said control means and wiring; a plurality of decorative panels removably installed as an assembly in said frame across said opening spaced forwardly of said fire wall panel, said decorative panel assembly defining an upper edge portion received in said recess, side edge portions, and a lower edge portion; cooperating male and female securing means on said frame and decorative panel assembly for securing said lower edge portion of the decorative panel assembly removably to said frame against movement forwardly from said space in an engaged disposition thereof while permitting limited movement of said decorative panel assembly vertically from said engaged disposition to permit said lower edge portion to be moved forwardly from said space and thereby permit said upper edge portion to be moved downwardly from said recess to remove said decorative panel assembly from said door construction, and permit installation of said decorative panel assembly by a reverse procedure; flange means removably mounted on said frame defining formed, inturned flanges forwardly overlying said side edge portions of the decorative panel assembly; and biasing means for biasing said decorative panel assembly against said inturned flanges to retain said decorative panels in facial abutment in said assembly while permitting limited movement of said decorative panel assembly vertically from said engaged disposition to permit said lower edge portion to be moved forwardly from said space and thereby permit said upper edge portion to be moved downwardly from said recess to remove said decorative panel assembly from said door construction, and permit installation of said decorative panel assembly by a reverse procedure, said biasing means being spaced substantially from said lower edge to maintain facial abutment while being disposed to urge said decorative panel assembly from said frame upon movement of said lower edge portion from said engaged disposition.

9. The door construction of claim 8 wherein said decorative panel assembly is spaced forwardly of said fire wall panel by said biasing means.

10. The door construction of claim 8 wherein said biasing means comprises resilient means engaging an upper portion of the decorative panel assembly.

11. The door construction of claim 8 wherein said biasing means comprises a pair of spring clips carried by said frame one each at opposite sides of said decorative panel assembly and engaging an upper portion of the decorative panel assembly to space said decorative panel assembly forwardly of said fire wall panel.

12. The door construction of claim 8 wherein said decorative panel assembly includes a protective panel at the rear of said plurality of decorative panels.

13. The door construction of claim 12 wherein said biasing means engages said protective panel.

14. The door construction of claim 12 wherein said biasing means comprises spring clips on said frame engaging said protective panel and urging said upper edge portion of the decorative panel assembly forwardly.

15. The door construction of claim 8 wherein said decorative panel assembly has a thickness of approximately ¼ inch.

16. The door construction of claim 8 wherein each of said decorative panels comprises a painted panel.

17. In a door construction for an electrically operable appliance, having a peripheral frame defining an opening, and electrical control means carried by said frame including wiring extending at the rear of said opening, the improvement comprising: a console enclosure carried at the top of said frame for enclosing the control means and defining a downwardly opening recess extending substantially fully across said opening; a fire wall panel extending across said opening and forwardly of said control means and wiring; decorative panel means removably installed in said frame across said opening forwardly of said fire wall panel, said decorative panel means defining an upper edge portion received in said recess, side edge portions, and a lower edge portion; securing means for securing said lower edge portion against movement forwardly from said space in an engaged disposition thereof while permitting limited movement of said decorative panel means vertically from said engaged disposition to permit said lower edge portion to be moved forwardly from said space and thereby permit said upper edge portion to be moved downwardly from said recess to remove said decorative panel means from said door construction, and permit installation of said decorative panel means by a reverse procedure, said biasing means comprising spring clip means, said spring clip means further defining means for securing said fire wall panel to said frame.

18. In a door construction for an electrically operable appliance, having a peripheral frame defining an opening, and electrical control means carried by said frame including wiring extending at the rear of said opening, the improvement comprising: a console enclosure carried at the top of said frame for enclosing the control means and defining a downwardly opening recess extending substantially fully across said opening; decorative panel means removably installed in said frame across said opening, said decorative panel means defining an upper edge portion received in said recess and a lower edge portion, said decorative panel means including a plurality of facially juxtaposed decorative panels having differently appearing faces interchangeably disposed with a selected face of a selected panel forwardmost to be viewed from the front of the door construction to provide any one of a plurality of different panel appearances therein; and securing means for securing said lower edge portion against movement forwardly from said space in an engaged disposition thereof while permitting limited movement of said decorative panel means vertically from said engaged disposition to permit said lower edge portion to be moved forwardly from said space and thereby permit said upper edge portion to be moved downwardly from said recess to remove said decorative panel means from said door construction, and permit installation of said decorative panel means by a reverse procedure, said decorative panel means further including a protective panel at the rear of said plurality of decorative panels formed of wax impregnated corrugated fiber panels.

* * * * *